US006486427B1

(12) United States Patent
Pruvot

(10) Patent No.: US 6,486,427 B1
(45) Date of Patent: Nov. 26, 2002

(54) ELECTRICAL SWITCH

(75) Inventor: Anthony Pruvot, Chateau-Gontiér (FR)

(73) Assignee: Molex Incorporated, Lisle, IL (US)

( * ) Notice: Subject to any disclaimer, the term of this patent is extended or adjusted under 35 U.S.C. 154(b) by 149 days.

(21) Appl. No.: 09/661,512

(22) Filed: Sep. 13, 2000

(30) Foreign Application Priority Data

Sep. 22, 1999 (EP) ..... 99118663

(51) Int. Cl.[7] ..... H01H 5/18
(52) U.S. Cl. ..... 200/406; 200/512
(58) Field of Search ..... 200/406, 5 A, 200/5 R, 343, 512–517, 518, 292, 329

(56) References Cited

U.S. PATENT DOCUMENTS 3,969,595 A * 7/1976 Johnson ..... 200/5 A
4,262,182 A * 4/1981 Basler et al. ..... 200/314
4,385,218 A * 5/1983 Nishida ..... 200/159 B
4,463,234 A * 7/1984 Bennewitz ..... 200/159 B
5,986,221 A * 11/1999 Stanley ..... 177/136
6,069,552 A * 5/2000 Van Zeeland ..... 338/92
6,100,484 A * 8/2000 Houze et al. ..... 200/512
6,133,536 A * 10/2000 Hunag et al. ..... 200/5 A
6,333,477 B1 * 12/2001 Koyama et al. ..... 200/513

* cited by examiner

*Primary Examiner*—Michael Friedhofer
*Assistant Examiner*—Lisa N Klaus
(74) *Attorney, Agent, or Firm*—Stephen Z. Weiss

(57) ABSTRACT

A laminated electrical switch includes an insulative substrate having a lower stamped metal circuit sheet supported thereon. The lower sheet includes a plurality of switch contacts and a plurality of leads for connecting the switch contacts to appropriate conductors. An upper stamped metal sheet is disposed over the insulative substrate and includes a plurality of embossed metal domes in registry with and spaced from respective ones of the switch contacts. Depression of a selected one of the embossed metal domes engages the dome with a respective one of the switch contacts to close a circuit therethrough.

17 Claims, 3 Drawing Sheets

ELECTRICAL SWITCH

FIELD OF THE INVENTION

This invention generally relates to the art of electrical switches and, particularly, to laminated electrical switches of the push-button type.

BACKGROUND OF THE INVENTION

Push-button electrical switches have been designed in a wide variety of configurations for a wide variety of applications. Such switches range from substantial three-dimensional structures having box-like housings to very thin or laminated switches, sometimes called "membrane" switches. Thin laminated switches often are used in conjunction with printed circuit boards. This invention is directed to improvements in such laminated switches.

SUMMARY OF THE INVENTION

An object, therefore, of the invention is to provide a new and improved electrical switch of the character described.

In the exemplary embodiment of the invention, the electrical switch includes an insulative substrate having a lower stamped metal circuit sheet supported thereon. The lower sheet includes a plurality of switch contacts and a plurality of leads for connecting the switch contacts to appropriate conductors. An upper stamped metal sheet is disposed over the insulative substrate and includes a plurality of embossed metal domes in registry with respective ones of the switch contacts. Depression of a selected one of the embossed metal domes engages the dome with a respective one of the switch contacts to close a circuit therethrough.

As disclosed herein, the lower stamped metal circuit sheet is insert molded in the insulative substrate and includes a common contact in engagement with the upper stamped metal sheet. The common contact is in the form of a peripheral contact outside the plurality of switch contacts. The upper stamped metal sheet includes a peripheral frame outside the plurality of embossed metal domes. The peripheral frame is in engagement with the peripheral contact. The plurality of embossed metal domes are electrically coupled to the peripheral frame.

A feature of the invention includes the insulative substrate having a plurality of integral pegs extending through apertures in the peripheral contact of the lower stamped metal circuit sheet and through apertures in the peripheral frame of the upper stamped metal sheet. The pegs are deformed, as by staking, to hold the upper stamped metal sheet and the insulative substrate together, with the peripheral contact in engagement with the peripheral frame.

In an alternative embodiment of the invention, an insulated circuit sheet is disposed between the upper stamped metal sheet and the insulative substrate. The insulated circuit sheet includes conductive pads in registry between the embossed metal domes and the switch contacts. The insulated circuit sheet is configured to hermetically seal the insulative substrate and lower stamped metal circuit sheet.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENTS

Figure 1:
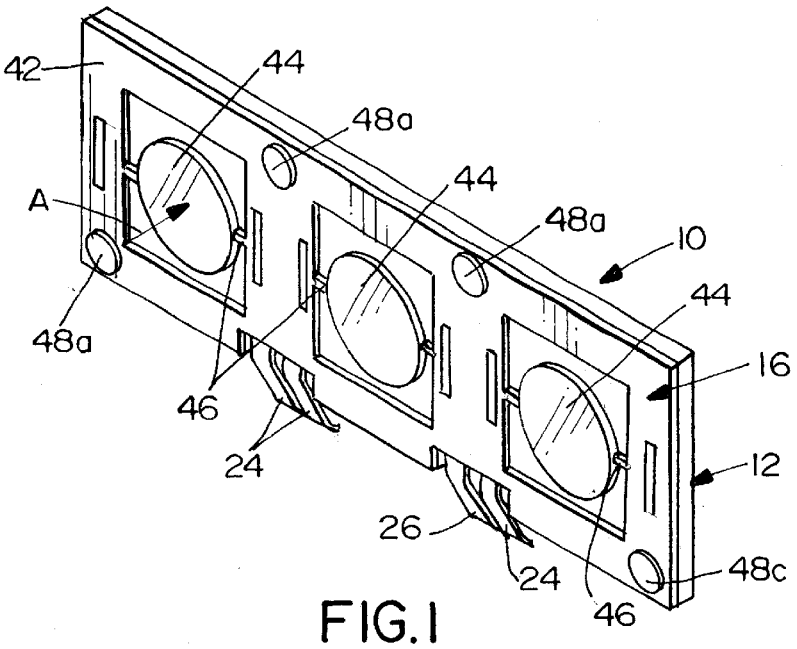
FIG. 1 is a top perspective view of a first embodiment of the electrical switch according to the invention.

Referring to the drawings in greater detail, FIG. 1 shows an electrical switch, generally designated 10, according to a first embodiment of the invention. The switch includes three major components, namely: an insulative substrate, generally designated 12 and best seen in FIGS. 2 and 5; a lower stamped metal circuit sheet, generally designated 14, supported on insulative substrate 12 and best seen in FIG. 4; and an upper stamped metal sheet, generally designated 16 and best seen in FIGS. 1, 3 and 5.

Figure 4:
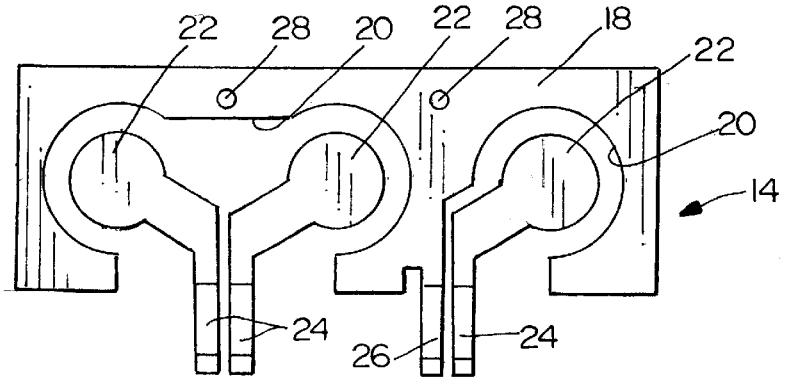
FIG. 4 is a top plan view of the lower stamped metal circuit sheet.

Turning first to the lower stamped metal circuit sheet 14 of FIG. 4, the circuit sheet includes a generally rectangular, common peripheral contact 18 having cutouts 20 so that the common peripheral contact substantially surrounds and is spaced from a plurality of switch contacts 22. The peripheral contact 18 may have other suitable shapes. The switch contacts are generally circular or disk-shaped and include leads 24 projecting beyond common peripheral contact 18 which includes it own lead 26. Leads 24 and 26 of all of the contacts connect the contacts to appropriate conductors such as the circuit traces on a printed circuit board. Finally, common peripheral contact 18 includes at least one aperture 28 for purposes described hereinafter. A pair of apertures 28 are shown in the peripheral contact 18 of FIG. 4.

Figure 2:
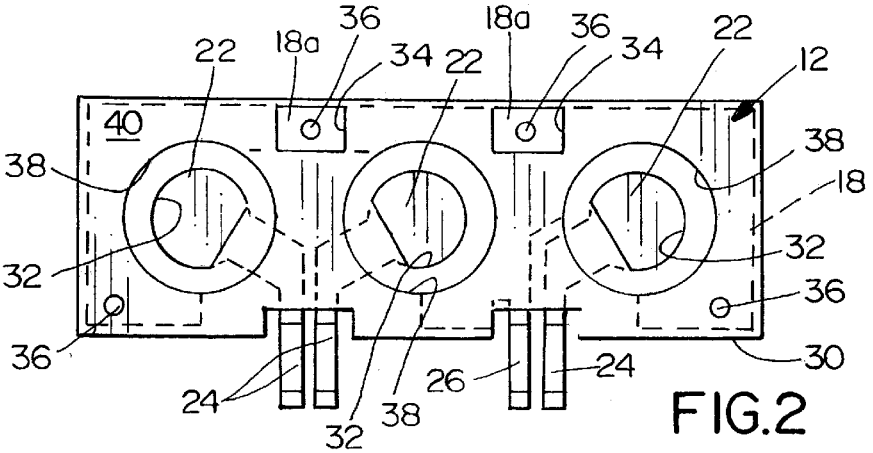
FIG. 2 is a top plan view of the switch, with the upper stamped metal sheet removed.
Figure 3:
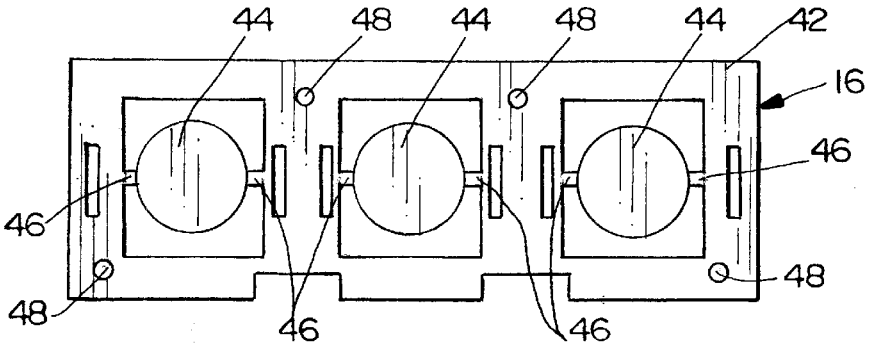
FIG. 3 is a top plan view of the upper stamped metal sheet, alone.
Figure 5:
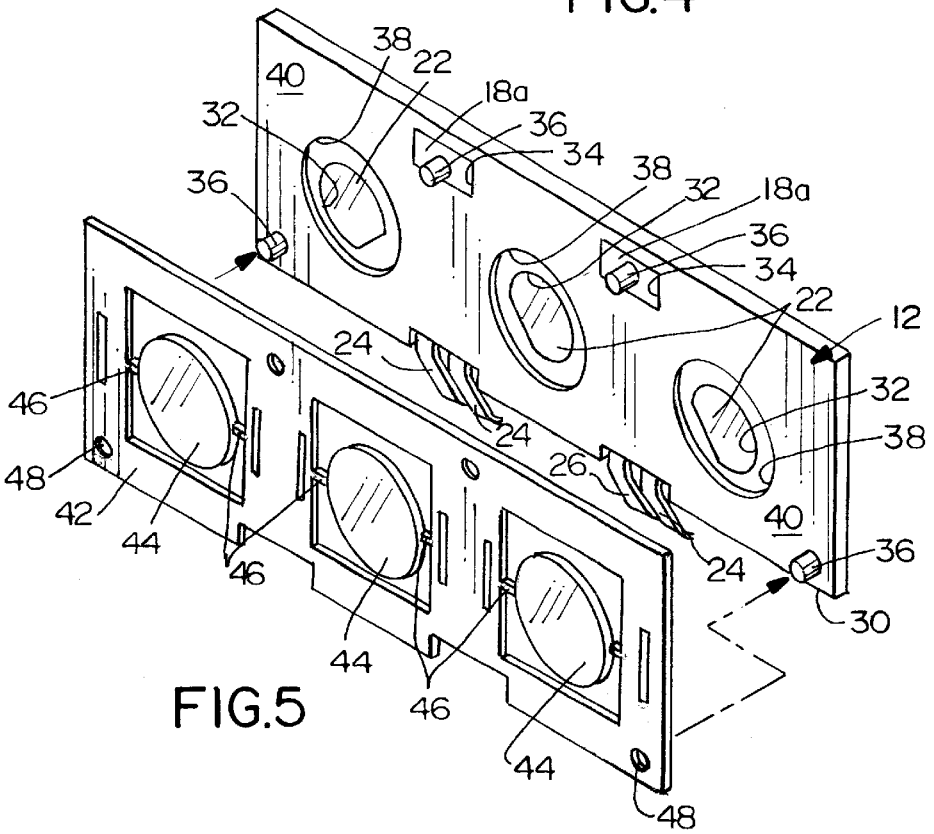
FIG. 5 is a perspective view of the upper stamped metal sheet about to be assembled to the insulative substrate.

FIGS. 2 and 5 show insulative substrate 12 to be generally rectangular and slightly larger than the peripheral bounds of common peripheral contact 18 of lower stamped metal circuit sheet 14. However, the insulative substrate does not have to be rectangular in shape or larger than the peripheral bounds of the common peripheral contact 18 and may even be smaller. In fabrication, substrate 12 is of a dielectric material such as plastic or the like and is overmolded about the lower circuit sheet 14 except for leads 24 and 26 which project beyond one edge 30 of the substrate and except for switch contacts 22 which are exposed through circular openings 32 in the substrate. In addition, portions 18*a* of common peripheral contact 18 of lower circuit sheet 14 are exposed through rectangular openings 34 in the substrate. A plurality of pegs 36 are molded integrally with the substrate and project forwardly thereof as seen best in FIG. 5. Finally, countersunk circular areas 38 surround circular openings 32 in the substrate. Therefore, switch contacts 22 are preferably spaced below a top surface 40 of the substrate.

Upper stamped metal sheet 16 is disposed over insulative substrate 12 and includes a generally rectangular peripheral frame 42 of substantially the same dimensions as the substrate so that the frame can be assembled onto top surface 40 of the substrate. When the upper stamped metal sheet is assembled onto the substrate, peripheral frame 42 engages exposed portions 18*a* (FIG. 5) of common peripheral contact 18 (FIG. 4) of lower circuit sheet 14.

Upper stamped metal sheet 16 also includes a plurality (three in the embodiment shown) of embossed metal domes 44 which are in registry with the three switch contacts 22 of lower circuit sheet 14 when the upper metal sheet is assembled to substrate 12. In other words, the switch contacts are exposed through openings 32 in the substrate which, in turn, are in registry with embossed metal domes 44. The embossed metal domes are electrically coupled or commoned to peripheral frame 42 by integral web portions 46 of the upper stamped metal sheet. Finally, the upper stamped metal sheet includes a plurality of apertures 48 for receiving integral pegs 36 of insulative substrate 12. The pegs and apertures not only align the upper stamped metal sheet with the substrate and the switch contacts, but the pegs are deformed or staked as shown at 48*a* in FIG. 1 to hold the upper stamped metal sheet against front face 40 of the substrate and to hold peripheral frame 42 of the metal sheet in engagement with portions 18*a* of common peripheral contact 18 through rectangular openings 34 in the substrate.

When it is desirable to engage a selected one of the embossed metal domes 44 with the respective switch contact 22 which is in registry with that selected metal dome, the dome is depressed in the direction of arrow "A" (FIG. 1). The embossed dome enters countersunk area 38 in insulative substrate 12 and into engagement with the respective switch contact 22. With peripheral frame 42 of upper stamped metal sheet 16 already in constant engagement with common peripheral contact 18 of lower stamped metal circuit sheet 14, a circuit is closed through the switch contact in registry with the selected embossed metal dome and the common peripheral contact of the lower sheet.

Alternatively, if the switch contacts 22 are flush with the top surface of the molded substrate 12, a spacer sheet (not shown) with apertures in registry with the switch contacts 22 may be laminated on the substrate 12. In such an alternative to the first embodiment, the upper stamped metal sheet would be assembled onto the top surface of the spacer sheet and the embossed metal domes 14 would engage the respective switch contact 22 through the respective aperture in the spacer sheet.

Figure 6:
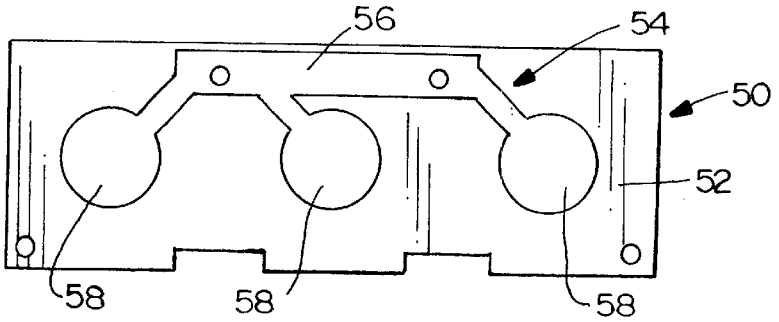
FIG. 6 is a top plan view of an insulated circuit sheet employed in a second embodiment of the invention.
Figure 7:
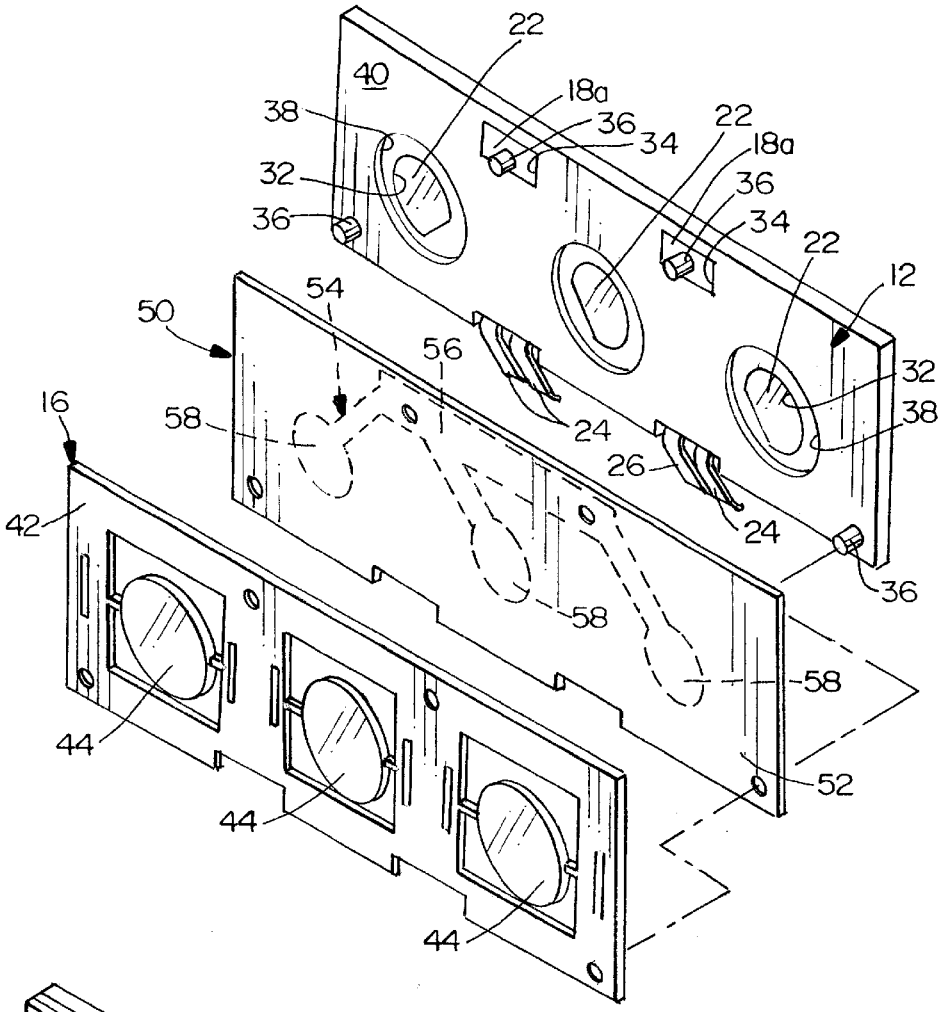
FIG. 7 is an exploded perspective view of an electrical switch according to the second embodiment.
Figure 8:
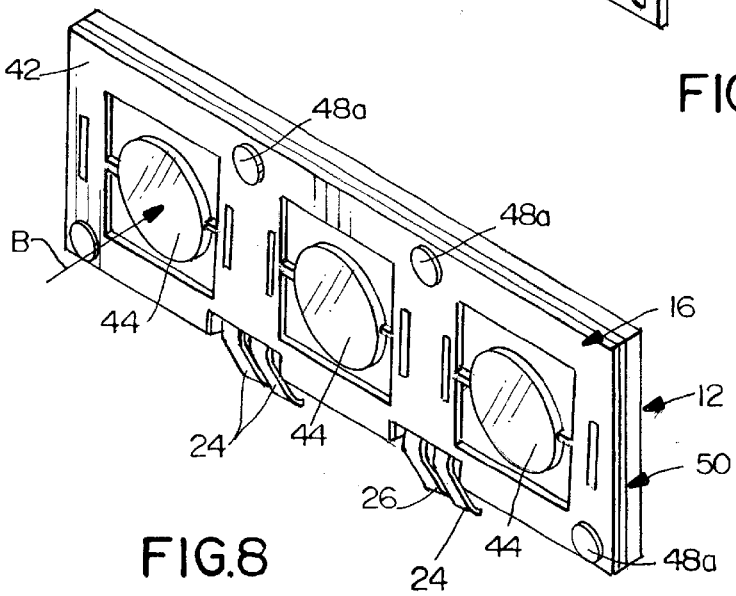
FIG. 8 is a view similar to that of FIG. 1, but of the second embodiment.

FIGS. 6–8 show a second embodiment of the invention and like numerals have been applied in FIGS. 7 and 8 corresponding to like components described above in relation to the first embodiment of FIGS. 1–5. Basically, the second embodiment of FIGS. 6–8 is identical to the first embodiment except for the addition of an insulated circuit sheet, generally designated 50 and seen best in FIGS. 6 and 7. The insulated circuit sheet is disposed between upper stamped metal sheet 16 and insulative substrate 12 which has lower conductive circuitry 14 overmolded therewithin.

More particularly, insulated circuit sheet 50 is formed by a dielectric film 52 having circuitry, generally designated 54, printed or laminated thereon, at least on the back or rear side thereof. Circuitry 54 includes a common contact 56 which is maintained in constant engagement with portions 18*a* of common peripheral contact 18 of lower stamped metal circuit sheet 14 through rectangular openings 34 in insulative substrate 12. Circuitry 54 includes conductive pads 58 in registry with switch contacts 22 of lower conductive circuit sheet 14. Contact pads 58 do not engage switch contacts 22 as the film-like circuit sheet 50 is disposed flush onto top face 40 of substrate 12, and switch contacts 22 are recessed within countersunk areas 38 of the substrate.

In the second embodiment of FIGS. 6–8, when a selected one of embossed domes 44 of sheet 16 is depressed in the direction of arrow "B" (FIG. 8) the dome engages the aligned conductive pad 58 of circuit sheet 50 and drives the pad into engagement with the aligned switch contact 22. With the conductive pad being commoned to peripheral contact 18 of lower stamped metal circuit sheet 14 through common contact 56 of circuit sheet 54, a circuit is closed through the selected switch contact and the common contact of lower circuit sheet 14. In the second embodiment, upper sheet 16 could be of plastic material.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A laminated electrical switch, comprising:

an insulative substrate;

a lower stamped metal circuit sheet supported on the insulative substrate and including a common contact, a plurality of switch contacts and a plurality of leads for connecting the common contact and the switch contacts to appropriate conductors; and an upper stamped metal sheet disposed over the insulative substrate in engagement with the common contact of the lower stamped metal circuit sheet and including a plurality of embossed metal domes in registry with and spaced from respective ones of the switch contacts, whereby depression of a selected one of the embossed metal domes engages the dome with a respective one of the switch contacts to close a circuit between the common contact and the respective one of the switch contacts.

2. The electrical switch of claim 1, including an insulated circuit sheet disposed between said upper stamped metal sheet and said insulative substrate and including conductive pads in registry between the embossed metal domes and the switch contacts and engageable with the switch contacts.

3. The electrical switch of claim 2 wherein said insulated circuit sheet is configured to hermetically seal said insulative substrate and lower stamped metal circuit sheet.

4. The electrical switch of claim 1 wherein said lower stamped metal circuit sheet is insert molded in the insulative substrate.

5. The electrical switch of claim 1 wherein said common contact comprises a peripheral contact outside said plurality of switch contacts.

6. The electrical switch of claim 5 wherein said upper stamped metal sheet includes a peripheral frame outside said plurality of embossed metal domes, the peripheral frame being in engagement with said peripheral contact.

7. The electrical switch of claim 6 wherein said insulative substrate includes a plurality of integral pegs extending through apertures in the peripheral contact of the lower stamped metal circuit sheet and through apertures in the peripheral frame of the upper stamped metal sheet, the pegs being deformed to hold the upper stamped metal sheet and insulative substrate together with the peripheral contact in engagement with the peripheral frame.

8. The electrical switch of claim 5 wherein said plurality of embossed metal domes are electrically coupled to the peripheral frame.

9. The electrical switch of claim 1 wherein said plurality of embossed metal domes are electrically coupled together.

10. A laminated electrical switch, comprising:

an insulative substrate;

a lower stamped metal circuit sheet insert molded in the insulative substrate and including a common contact and a plurality of switch contacts with a plurality of leads for connecting the common contact and the switch contacts to appropriate conductors; and an upper stamped metal sheet disposed over the insulative substrate and including a portion in engagement with the common contact of the lower stamped metal circuit sheet and a plurality of embossed metal domes in registry with and spaced from respective ones of the switch contacts, whereby depression of a selected one of the embossed metal domes engages the dome with a respective one of the switch contacts to close a circuit through the respective switch contact and the common contact.

11. The electrical switch of claim 10, including an insulated circuit sheet disposed between said upper stamped metal sheet and said insulative substrate and including conductive pads in registry between the embossed metal domes and the switch contacts and engageable with the switch contacts.

12. The electrical switch of claim 11 wherein said insulated circuit sheet is configured to hermetically seal said insulative substrate and lower stamped metal circuit sheet.

13. The electrical switch of claim 10 wherein said common contact comprises a peripheral contact outside said plurality of switch contacts.

14. The electrical switch of claim 13 wherein said upper stamped metal sheet includes a peripheral frame outside said plurality of embossed metal domes, the peripheral frame being in engagement with said peripheral contact.

15. The electrical switch of claim 14 wherein said insulative substrate includes a plurality of integral pegs extending through apertures in the peripheral contact of the lower stamped metal circuit sheet and through apertures in the peripheral frame of the upper stamped metal sheet, the pegs being deformed to hold the upper stamped metal sheet and insulative substrate together with the peripheral contact in engagement with the peripheral frame.

16. The electrical switch of claim 13 wherein said plurality of embossed metal domes are electrically coupled to the peripheral frame.

17. The electrical switch of claim 10 wherein said plurality of embossed metal domes are electrically coupled together.

* * * * *